US006050193A

United States Patent [19]

DeBoer et al.

[11] Patent Number: 6,050,193

[45] **Date of Patent: *Apr. 18, 2000**

[54] IMAGING AND PRINTING METHODS TO FORM FINGERPRINT PROTECTED IMAGING MEMBER

[75] Inventors: Charles D. DeBoer, Palmyra; Judith L. Fleissig, Rochester, both of N.Y.

[73] Assignee: Eastman Kodak Company, Rochester, N.Y.

[ * ] Notice: This patent is subject to a terminal disclaimer.

[21] Appl. No.: 09/123,048

[22] Filed: Jul. 27, 1998

[51] Int. Cl.[7] ..... B41C 1/10

[52] U.S. Cl. ..... 101/466; 101/457; 101/462

[58] Field of Search ..... 101/453–455, 101/457, 460, 462, 463.1, 465–467; 347/95, 96, 100

[56] References Cited

U.S. PATENT DOCUMENTS

| | | | |
|---|---|---|---|
| 3,416,153 | 12/1968 | Hertz et al. | 347/73 |
| 3,705,043 | 12/1972 | Zabiak | 106/31.46 |
| 3,846,141 | 11/1974 | Ostergren et al. | 106/31.43 |
| 3,870,528 | 3/1975 | Edds et al. | 106/31.47 |
| 3,889,269 | 6/1975 | Meyer et al. | 347/100 |
| 3,903,034 | 9/1975 | Zabiak et al. | 524/247 |
| 4,003,312 | 1/1977 | Gunther | 101/466 |
| 4,303,924 | 12/1981 | Young, Jr. | 347/102 |
| 4,599,627 | 7/1986 | Vollert | 347/20 |
| 4,833,486 | 5/1989 | Zerillo | 101/463.1 |
| 5,312,654 | 5/1994 | Arimatsu et al. | 347/95 |
| 5,466,658 | 11/1995 | Harrison et al. | 503/227 |
| 5,495,803 | 3/1996 | Gerber et al. | 101/401.1 |
| 5,501,150 | 3/1996 | Leenders et al. | 101/466 |
| 5,511,477 | 4/1996 | Adler et al. | 101/401.1 |
| 5,738,013 | 4/1998 | Kellett | 101/467 |

FOREIGN PATENT DOCUMENTS

| | | |
|---|---|---|
| 0 776 763 A1 | 6/1997 | European Pat. Off. . |
| 53-015905 | 2/1978 | Japan . |
| 56-105960 | 10/1981 | Japan . |
| 62-025081 | 2/1987 | Japan . |
| 94/11191 | 5/1994 | WIPO . |

*Primary Examiner*—Stephen R. Funk
*Attorney, Agent, or Firm*—J. Lanny Tucker

[57] ABSTRACT

An imaging member can be prepared by imagewise application of a fluid onto a water-soluble fluid-receiving layer coated on a hydrophilic support. Application is preferably accomplished by ink jet printing. The fluid is dried or cured to form an oleophilic image on the fluid-receiving layer. After removal of the non-imaged areas, the resulting imaging member can be used for lithographic printing. The fluid-receiving layer is designed to protect the resulting imaging member from fingerprints or other handling defects.

18 Claims, 1 Drawing Sheet

IMAGING AND PRINTING METHODS TO FORM FINGERPRINT PROTECTED IMAGING MEMBER

COPENDING APPLICATIONS

Copending and commonly assigned U.S. Ser. No. 09/067,247, now U.S. Pat. No. 5,970,873, filed by DeBoer and Fleissig on Apr. 27, 1998.

Copending and commonly assigned U.S. Ser. No. 09/122,875 filed on even date herewith by DeBoer and Fleissig, and entitled IMAGING AND PRINTING METHODS TO FORM IMAGING MEMBER BY FLUID APPLICATION TO FLUID-RECEIVING ELEMENT.

FIELD OF THE INVENTION

This invention relates to imaging members prepared by application of a fluid to a water-soluble, fingerprint-protected receiving layer on a hydrophilic support. The invention also relates to a method of using the imaging members for lithographic printing.

BACKGROUND OF THE INVENTION

The art of lithographic printing is based upon the immiscibility of oil and water, wherein the oily material (or ink) is preferentially retained by image areas on a substrate. When a suitably prepared surface is moistened with water and an ink is applied, certain areas retain the water and repel the ink, and other areas accept the ink and repel the water. Ink can then be transferred to the surface of a suitable receiving material, such as cloth, paper or metal, thereby reproducing the image. Commonly, the ink is transferred to an intermediate material known as a blanket which in turn transfers the ink image to the surface of the final receiving material upon which the image is to be reproduced.

Conventional lithographic printing plates typically include a hardenable polymeric layer (usually visible or UV light-sensitive) on a suitable metallic or polymeric support. Both positive- and negative-working printing plates can be prepared in this fashion. Upon exposure, and perhaps post-exposure heating, either imaged or non-imaged areas are removed using wet processing chemistries.

Thermally sensitive printing plates are also known. They include an imaging layer comprising a mixture of dissolvable polymers and an infrared radiation absorbing compound. While these plates can be imaged using lasers and digital information, they require wet processing using alkaline developers to provide the printable image.

Dry planography, or waterless printing, is well known in the art of lithographic offset printing and provides several advantages over conventional offset printing. Dry planography is particularly advantageous for short run and on-press applications. It simplifies press design by eliminating the fountain solution and aqueous delivery train. Careful ink water balance is unnecessary, thus reducing rollup time and material waste. Use of silicone rubber, [such as poly (dimethylsiloxane) and other derivatives of poly(siloxanes)] have long been recognized as preferred waterless-ink repelling materials.

Herein, ink-repelling materials are defined as "oleophobic" and, conversely, the term "oleophilic" is used to describe ink "loving" or accepting materials.

The planographic materials noted above are the object of considerable development effort in the industry, but due to a number of performance problems or costs, there remains a need to explore other means for providing printed images using sources of digital information, such as digitally controlled printing devices.

Many different types of digitally controlled imaging or printing systems are known. These systems utilize a variety of actuation mechanisms, marking materials and recording media. Examples of such systems include, but are not limited to, laser electrophotographic printers, LED electrophotographic printers, dot matrix impact printers, thermal paper printers, film recorders, thermal wax printers, dye diffusion thermal transfer printers, and ink jet printers. Due to various disadvantages or limitations, such digital printing systems have not significantly replaced mechanical printing presses and the more conventional printing plates described above, even though these older systems are labor intensive and inexpensive only when more than a few thousand copies of the same image are wanted. Yet, there is considerable activity in the industry to prepare recording media that can be digitally imaged and used to provide high quality, inexpensive copies in either a short- or long-run job.

Ink jet printing has become recognized as a viable alternative in the industry because of its non-impact deposition of ink droplets, low-noise characteristics, its use of plain paper as a receiving material, and its avoidance of toner transfer and fixing (as in electrophotography). Ink jet printing mechanisms can be characterized as either continuous ink jet or "drop on demand" ink jet printing. Various ink jet printers and systems are currently available for a number of markets, including their common use with personal computers. A very essential aspect of such systems, of course, is a printing ink that has all of the necessary properties for a given application.

Various teachings about ink jet printing including nozzles and drop modulation are described, for example, in U.S. Pat. No. 1,941,001 (Hamsell), U.S. Pat. No. 3,373,437 (Sweet et al), U.S. Pat. No. 3,416,153 (Hertz et al), U.S. Pat. No. 3,878,519 (Eaton), and U.S. Pat. No. 4,346,387 (Hertz).

Printing plates have been made using ink jet printing, as described for example in U.S. Pat. No. 4,003,312 (Gunther), U.S. Pat. No. 4,833,486 (Zerillo), U.S. Pat. No. 5,501,150 (Leenders et al), U.S. Pat. No. 4,303,924 (Young), U.S. Pat. No. 5,511,477 (Adler et al), U.S. Pat. No. 4,599,627 (Vollert), U.S. Pat. No. 5,466,658 (Harrison et al), and U.S. Pat. No. 5,495,803 (Gerber et al).

JP Kokai 53-015905 describes the preparation of a printing plate by ink jet printing using ink comprising an alcohol-soluble resin in an organic solvent onto an aluminum support. Similarly, JP Kokai 56-105960 describes ink jet printing using an ink comprising a hardening substance, such as an epoxy-soybean oil, and benzoyl peroxide, or a photohardenable polyester, onto a metallic support. These inks are disadvantageous in that they include light-sensitive materials or environmentally unsuitable organic solvents.

EP-A-0 776,763 (Hallman et al) describes ink jet printing of two reactive inks that combine to form a polymeric resin on a printing plate. JP Kokai 62-25081 describes the use of an oleophilic liquid as an ink jet ink.

Inks for high-speed ink jet drop printers must have a number of special characteristics. Typically, water-based inks have been used because of their conductivity and viscosity range. Thus, for use in a jet drop printer the ink must be electrically conductive, having a resistivity below about 5000 ohm-cm and preferably below about 500 ohm-cm. For good fluidity through small orifices, the water-based inks generally have a viscosity in the range between 1 and 15 centipose at 25° C.

Beyond this, the inks must be stable over a long period of time, compatible with ink jet materials, free of microorganisms and functional after printing. Required functional characteristics include resistance to smearing after printing, fast drying on paper, and being waterproof when dried.

Thus, problems to be solved with aqueous ink jet inks include the large energy needed for drying, cockling of large printed areas on paper surfaces, ink sensitivity to rubbing, the need for an anti-microbial agent and clogging of the ink jet printer orifices from dried ink.

Some of these problems may be overcome by use of polar, conductive organic solvent-based ink formulations. However, non-polar solvents generally lack sufficient conductivity. Addition of solvent soluble salts can make such solvents conductive, but such salts are often toxic, corrosive and unstable, and therefore present a number of reasons why they should be avoided.

It would be desirable to have a means for preparing printing plates using ink jet printing techniques in an economical fashion, at high speed without the limitations of requiring electrically conductive ink and without the problems noted above particularly for aqueous inks. It is also desirable that printing plates prepared in this fashion would be long wearing, that is useful for long press runs.

An advance in the art is provided by the ink jetable fluid described in copending and commonly assigned U.S. Ser. No. 09/067,247 (noted above). That fluid is composed of a suitable fluid solvent and a sol precursor that upon drying forms a porous colloidal sol-gel upon removal of the liquid solvent. While this fluid is highly useful, there is a continuing need for an improved element to which the fluid can be applied to provide improved image discrimination and sharpness without a reduction in wearability.

Copending U.S. Ser. No. 09/122,985 (noted above) provides such an additional advance in the art. However, it has been found that damage to the printing plates can occur from fingerprints during handling and mounting on printing presses. Thus, an additional improvement to provide fingerprint protection is desired.

SUMMARY OF THE INVENTION

The problems noted above are overcome with the imaging method of this invention. This method comprises the steps of:

A) imagewise applying a fluid to a fluid-receiving element that includes a hydrophilic support having thereon a water-soluble fluid-receiving layer, and B) drying or curing the applied fluid to provide an imaging member having an oleophilic image on the surface thereof, wherein the fluid-receiving layer does not prevent attachment of the dried or cured fluid to the hydrophilic support.

This invention provides an imaging member prepared using the method described above.

In some embodiments of this invention, the noted method further includes the steps of:

C) contacting the oleophilic image on the imaging member with a lithographic printing ink, and D) imagewise transferring the printing ink to a receiving material.

In preferred embodiments, the fluid comprises a liquid and a sol precursor is a di- or triether, or di- or triester of a metal oxide, the metal oxide also having at least one melanophilic non-ether or non-ester side chain that has up to 25% of its molecular weight being contributed by oxygen, nitrogen or sulfur atoms, and the rest of its molecular weight being contributed by carbon and hydrogen atoms, the metal oxide being a silicon, beryllium, magnesium, aluminum, germanium, arsenic, indium, tin, antimony, tellurium, lead, bismuth or transition metal oxide.

In this invention, the applied fluid is dried or cured to form a durable, solvent-insoluble, oleophilic image on the fluid-receiving element. The liquid in the fluid is believed to go into the fluid-receiving layer after application. Liquid removal can be facilitated by application of heat as described in detail below. Non-imaged areas of the fluid-receiving layer can be removed as described below. In addition, the resulting imaging member is protected from damage from handling during mounting on a printing press (for example, fingerprints, smudging and other handling defects) because the dried or cured fluid can actually become attached to the underlying hydrophilic support.

The fluid-receiving layer is composed of one or more water-soluble materials that are removed in non-imaged areas using a fountain solution during printing. Preferably, the fluid does not spread too much on the image receiving layer surface. If the fluid is merely applied to the hydrophilic substrate, the fluid spreads too readily, causing loss of image discrimination and sharpness. The resulting imaging members of this invention however have the required fluid-receiving layer on the hydrophilic substrate. They are easily and economically prepared using an ink jet printer, provide long press runs with high quality images, and have a printing surface that is protected from handling defects such as fingerprints.

DETAILED DESCRIPTION OF THE INVENTION

The following description of this invention is directed to the use of particular embodiments of ink jet fluids, imaging members and methods of their preparation and use. It is to be understood that embodiments not specifically described, but which would be variations obvious to one skilled in the art, are also included within the present invention.

Figure 1:
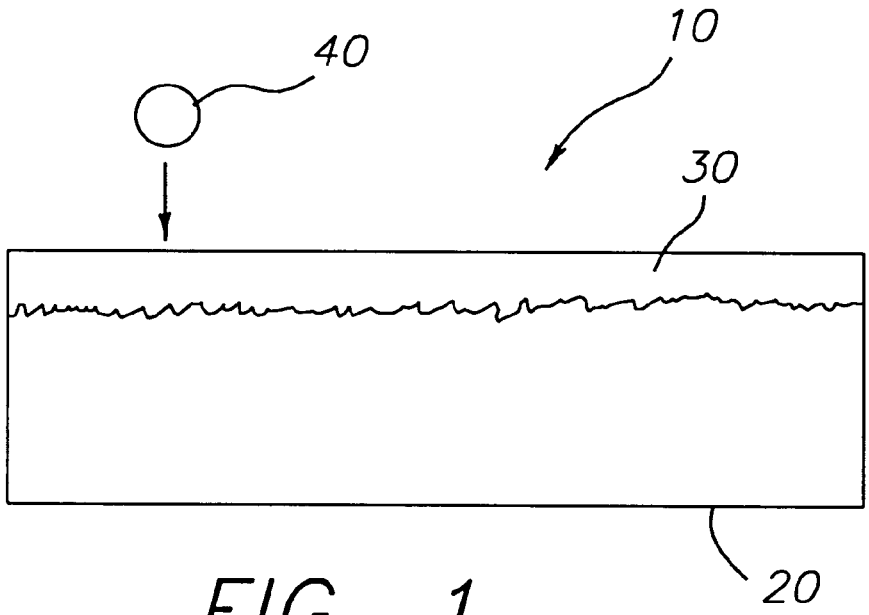
FIG. 1 is cross-sectional view of an imaging member used in the practice of this invention to which an ink jet fluid droplet is being applied.

Considering FIG. 1, imaging member 10 includes hydrophilic support 20 having disposed thereon fluid-receiving layer 30. Droplet 40 of an ink jet fluid is being applied to the surface of fluid-receiving layer 30 in the direction of the arrow.

Figure 2:
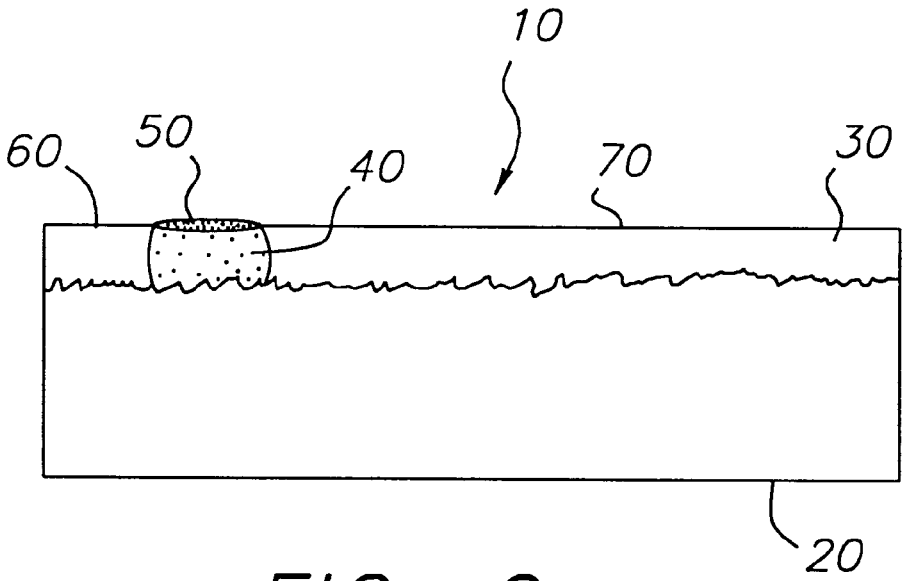
FIG. 2 is cross-sectional view of the imaging member shown in FIG. 1, after application of the ink jet fluid droplet. The applied droplet has been dried or cured and has become attached to the hydrophilic support.

In FIG. 2, ink jet fluid droplet 40 has been absorbed within fluid-receiving layer 30 and has come into contact with and become attached to hydrophilic support 20. When the liquid component of ink jet fluid droplet 40 is removed in a suitable fashion (such as by drying or curing), the resulting cured or dried fluid forms imaged area 50. Upon contact with a lithographic printing ink and fountain solution, non-imaged areas 60 and 70 of fluid-receiving layer 30 are removed leaving imaged area 50 only.

The hydrophilic supports useful in the present invention are generally abhesive to lithographic printing inks, and receptive to water. Such supports can be composed of metal, paper or polymer (such as polyesters or polyimides) sheets, foils or laminates thereof, as long as they have the requisite properties. Metal supports (such as aluminum, zinc or steel) are preferred for their dimensional stability. A particularly useful support is aluminum that has a roughened surface (using physical or chemical roughening to produce surface hydroxy groups) for improved hydrophilicity. Such supports will effectively repel lithographic printing inks and "hold" or accept water (or an aqueous fountain solution).

Polymeric supports can also be used for monochrome or spot color printing jobs where the positional variations or lack of dimensional stability is not important. The polymeric supports must be treated or provided with a hydrophilic surface. For example, a hydrophobic polyethylene terephthalate or polyethylene naphthalate film can be coated with a hydrophilic subbing layer composed of, for example, a dispersion of titanium dioxide particles in crosslinked gelatin to provide a roughened surface. Paper supports can be similarly treated and used in the practice of this invention.

Supports can have any desired thickness that would be useful for a given application, and to sustain the wear of a printing press and thin enough to wrap around a printing form, for example from about 100 to about 500 $\mu$m in thickness.

The fluid-receiving layer in the imaging member has a composition that enables it to receive (or possibly absorb or dissolve) the applied fluid.

In some embodiments of this invention, the applied fluid exhibits a contact angle of at least 20°, and preferably at least 30°, to provide improved image sharpness. Practically, the contact angle is generally less than 100°. More details of this property is described in copending U.S. Ser. No. 09/122,875 (noted above). This property is preferred, but not essential for the imaging materials formed using the present invention.

The fluid-receiving layer rapidly absorbs, or dissolves within, the applied fluid so that upon drying, the area to which the fluid is applied is discrete and the fluid-receiving layer can become firmly attached to the underlying hydrophilic support in some manner. In addition, the non-imaged areas of the fluid-receiving layer must be sufficiently soluble in water or conventional fountain solutions so it can be removed after imaging. Thus, the non-imaged areas may be removed when ink and a fountain solution are applied or in a separate step prior to inking.

An important function of the image-receiving layer is to prevent fingerprints or other handling defects on the hydrophilic support surface. As an example of the problem, when anodized aluminum is used as the hydrophilic support, a fingerprint made during mounting of the resulting imaging member onto a printing press, will sometimes "print" ink for several hundred impressions before being worn away. This is costly in time and the receiving materials onto which ink is printed, and reduces print quality.

The fluid-receiving layer, because it is water-soluble, is washed off after imaging with the fountain solution, removing any fingerprints thereon. However, it is important that the fluid-receiving layer does not prevent the attachment of the applied droplet to the hydrophilic support, or the resulting image will be worn away after a few impressions as the non-imaged areas of the fluid-receiving layer are dissolved in the fountain solution. The fluid-receiving layer can allow attachment to the hydrophilic support by reacting with the dried or cured fluid droplet, thus becoming a part of the dried polymeric matrix in the imaged areas. Alternatively, the fluid-receiving layer can become physically entangled with the polymeric matrix formed by the dried or cured fluid droplet. Still again, the polymer(s) of the fluid-receiving layer may be dissolved in a fountain solution or the solvent of the applied fluid droplet, and be somehow removed (such as removal in the fountain solution), leaving the separate phase droplets attached or bonded to the hydrophilic support in an imagewise fashion.

The fluid-receiving layer is therefore composed of generally water-soluble materials such as water-soluble cellulosic materials (for example hydroxypropylcellulose, hydroxyethylcellulose, hydroxypropylmethylcellulose and carboxymethylcellulose), water-soluble synthetic or naturally occurring polymers (for example polyvinyl alcohol, polyvinylpyrrolidones, polyacrylamides, water-absorbent starches, dextrin, amylogen, and copolymers derived from vinyl alcohol, acrylamides, vinylpyrrolidones, polyethenimine, and other water-soluble monomers), gum arabic (acacia gum), agar, algin, carrageenan, fucoidan, laminaran, corn hull gum, gelatin, gum ghatti, karaya gum, locust bean gum, pectin, dextrans, guar gum and other water-soluble film-forming materials that would be readily apparent to one skilled in the art. The cellulosic materials are preferred. Mixtures of any of these materials can be used also for this purpose. By "water-soluble" is meant that the material can form a greater than 1% solution in water.

It will be understood by those skilled in the art that a water-soluble polymer can be rendered water-insoluble by chemical crosslinking without significantly changing the hydrophilic surface properties. For the purposes of this application, such crosslinked polymers are considered water-soluble polymers as long at they will dissolve in water before any crosslinking occurs.

In some embodiments, the fluid-receiving layer can be composed of water-soluble materials that include groups that are reactive with the applied fluid, or components thereof. For example, the water-soluble materials may include polymers comprising activated vinyl groups that are reactive with mercapto containing compounds within the applied fluid.

The materials in the fluid-receiving layer can be applied to the hydrophilic support in any suitable manner using conventional coating equipment and procedures. Upon drying, the fluid-receiving layer is generally at least 0.1 $\mu$m in thickness and can be as thick as 3 $\mu$m. Thus, it must be thick and substantially continuous enough to provide the desired image upon fluid application, but not so thick that the non-imaged areas are difficult to remove after imaging.

The applied fluid used to make the imaging members is preferably an aqueous solution or dispersion of one or more materials that can be dried or cured to form an insoluble matrix within the fluid-receiving layer. Other solvents can be used as long as they are readily removed after fluid application and do not adversely affect the fluid-receiving layer.

A preferred fluid comprises a mixture of a liquid and a sol precursor, as described for example in copending and commonly assigned U.S. Ser. No. 09/067,247, noted above. A printable image on the imaging member is provided by imagewise applying in any suitable fashion (such as by ink jet printing) this fluid to form an insoluble inorganic polymeric sol-gel matrix upon drying.

In these embodiments, the fluid comprises one or more solvents as a carrier medium, such as water, polar organic solvents such as alcohols (for example, as ethanol, isopropanol, methanol and n-propanol), polyhydric alcohols (such as ethylene glycol, diethylene glycol, triethylene glycol and trimethylol propane), non-polar organic solvents (such as butanone, tetrahydrofuran or toluene). Water and ethanol are preferred. Mixtures of such solvents can also be used if desirable.

Dispersed or dissolved within the solvent(s) is one or more sol precursors. What is meant by "sol precursor" is a compound (or combination of compounds) that upon drying, forms a porous colloidal or "sol-gel" upon removal of liquid solvent or dispersing medium.

"Sols" is a term known to refer to a colloidal system of liquid character in which the dispersed particles (for example, of sol precursors) are either solid or large molecules whose dimensions are in the colloidal range (1–1000 nm in size). A "gel" is a colloidal system of solid character in which the dispersed sol precursor forms a continuous, coherent matrix interpenetrated (usually by liquid) by kinetic units smaller than colloidal units. A detailed discussion of sol-gels and their precursor materials, methods of preparation and background literature is provided by Gesser & Goswami in *Chem. Rev.,* Vol. 89, pages 765–788, 1989, incorporated herein by reference for its background information. It is clear that sol-gel matrices can be prepared using a variety of techniques for removing the dispersing liquid.

The sol-gel matrices formed according to these embodiments can be formed from one or more metal oxides of silicon, beryllium, magnesium, aluminum, germanium, arsenic, indium, tin, antimony, tellurium, lead, bismuth or transition metals. For purposes of this application, silicon is considered a "metal". Silicon oxide, aluminum oxide, titanium oxide and zirconium oxide compounds are preferred, and silicon oxide and titanium oxide compounds are most preferred, in the practice of this invention. Silicon oxide, aluminum oxide, titanium oxide and zirconium oxide are preferred for this use. Mixtures of oxides can also be used in any combination and proportions.

The sol-gel matrix can be composed completely of inorganic oxide(s), but in general, it may be desirable to include one or more organic binder materials therein, including gelatin and other hydrophilic colloids, acrylate (and methacrylate) polymers or polyvinyl alcohol. Gelatin is most preferred in this embodiment.

Generally, the amount of the one or more sol precursors in the fluid is at least 1 weight %, and preferably at least 10 weight %, and can be as high as 50 weight %.

The surface tension of the fluid is generally at least 20 and preferably at least 30 dynes/cm, and generally up to 60 and preferably up to 50 dynes/cm. Surface tension can be measured in a conventional manner, for example, using a commercially available du Nony Tensiometer (Scientific Products, McGaw Park, Ill.). Fluid viscosity can be generally no greater than 20 centipoise, and preferably from about 1 to about 10, and more preferably from about 1 to about 5, centipoise. Viscosity is measured in a conventional manner, for example, using a commercially available Brookfield Viscometer.

Where the sol-gel matrix includes organic components, the weight of the matrix is at least 10% by weight of carbon, and preferably, at least 25% by weight of carbon.

More preferably, the metal oxide is a di- or triether, or di- or triester metal oxide having at least one melanophilic non-ether or non-ester side chain. This non-ether or non-ester side chain is predominantly hydrocarbon in composition. That is, from 0 and up to 25% of the hydrocarbon side chain molecular weight is contributed by oxygen, nitrogen or sulfur atoms, and the rest of its molecular weight is contributed by carbon and hydrogen atoms.

Preferably, the metal oxide compound includes two or three ether or ester groups having from 1 or more oxygen atoms, and from 1 to 10 carbon atoms, and preferably from 1 to 3 carbon atoms. Useful ether and ester groups include, but are not limited to, methoxy, ethoxy, methoxymethyl, ethoxyethyl, acetoxy, propionic esters and other groups that would be readily apparent to one skilled in the art. Preferably, the ether groups are methoxy or ethoxy.

The melanophilic non-ether and non-ester side chain is an alkyl-substituted or unsubstituted phenyl (such as p-methylphenyl, xylyl and mesityl), or an aryl-substituted or unsubstituted alkyl group having 1 to 16 carbon atoms. By "melanophilic" it is meant that it is oil accepting and water repelling. Preferably, this side chain is one of the alkyl groups noted above (such as methyl, ethyl, n-propyl, isopropyl, n-butyl, n-hexyl and benzyl).

Preferably, the contribution by oxygen, nitrogen or sulfur atoms to the molecular weight of the non-alkoxy side chain is from 0 to 25%, and more preferably from 0 to 10%.

Representative compounds of this type include, but are not limited to, phenyltrimethoxysilane, phenyltriethoxysilane, ethyltrimethoxysilane, 3-aminopropyltriethoxysilane, methacryloxypropyltrimethoxysilane, aminoethylaminopropyltrimethoxysilane, triethoxysilanylethane, octyltriethoxysilane and isobutyltriethoxysilane, hafnium isopropoxide, zirconium isopropoxide, copper bis(2,2,6,6-tetramethyl-3,5-heptanedionate), and tantalum ethoxide. The most preferred compounds are substituted or unsubstituted alkyldi- or alkyltrialkoxysilanes such as 3-aminopropyltriethoxysilane. Epoxy-substituted di- or trialkoxysilanes, such as 3-glycidoxypropyltriethoxysilane, are also useful. Other useful compounds are mercapto-substituted di- or trialkoxysilanes.

When used with the fluid-receiving layer materials described herein, the alkyltrialkoxysilanes provide images that become attached or bonded to the hydrophilic support. Such bonding may occur upon reaction of the fluid-receiving layer polymer with the silane compound, forming a complex polymeric matrix. Alternatively, the fluid-receiving layer polymer may become physically entangled with the silicate matrix formed when the applied fluid is dried or cured. In is also possible that the fluid-receiving layer polymer may form a separate phase that is dissolved in a fountain solution, leaving the silicate matrix bonded to the hydrophilic support. In all of these instances, the applied fluid is not prevented from bonding or attaching to the hydrophilic support.

The fluids used in this invention can also include other addenda, including organic anionic or nonionic surfactants to provide the desired surface tension (for example, those described in U.S. Pat. No. 4,156,616, U.S. Pat. No. 5,324,349 and U.S. Pat. No. 5,279,654), humectants or co-solvents to keep the fluid from drying out or clogging the orifices of ink jet print heads, penetrants to help the fluid penetrate the surface of the support. A biocide, such as PROXEL™ GXL biocide (Zeneca Colors) or KATHON™ XL biocide (Rohm and Haas) may also be included to prevent microbial growth. Other addenda may be thickeners, pH adjusters, buffers, conductivity enhancing agents, drying agents and defoamers. The amounts of such materials in the fluids would be readily apparent to one skilled in the art. Preferably, the fluids are colorless, but may also contain soluble or dispersed colorants.

The fluids described herein can be applied to the fluid-receiving layer in any suitable manner that provides droplets to its surface in an imagewise fashion. Preferably, they are applied using ink jet printing techniques and devices.

Thus, the fluid can be applied using ink jet printing in a controlled, imagewise fashion to the surface of the fluid-receiving layer by ejecting droplets from a plurality of nozzles or orifices in a print head of an ink jet printer (such as a piezoelectric ink jet printing head). Commercially ink jet printers use various schemes to control the deposition of the droplets. Such schemes are generally of two types: continuous stream and drop-on-demand.

In drop-on-demand systems, the fluid droplets are ejected from orifices directly to a position on the support by pressure created by, for example, a piezoelectric device, an acoustic device, or a resistive heater controlled in accordance with digital signals. Thus, fluid droplets are not generated and ejected through the orifices of the print head unless they are needed to print pixels. Commercially available ink jet printers using such techniques are well known and need not be described in detail here.

Continuous ink jet printers have smaller drops and can be used, but the fluids must be conductive because the fluid droplets are deflected between the receiving material and a collection gutter by electrostatic deflectors.

The fluids described herein can have properties compatible with a wide range of ejecting conditions, for example, driving voltages and pulse widths for thermal ink jet printers, driving frequencies of the piezoelectric element for either a drop-on-demand device or a continuous device, and the shape and size of the nozzles.

Once the fluid has been applied to the fluid-receiving layer, the solvent is removed in any suitable fashion, such as drying, wicking, evaporation, sublimation or combinations thereof. Drying can be accomplished using any suitable source of energy that will evaporate the liquid without harming the water-insoluble matrix that is formed in the fluid-receiving layer. Preferably, the imaging member is dried to form the durable, water-insoluble, inorganic polymeric matrix described above. Drying means and conditions can vary depending upon the viscosity of the fluid, the solvent used, and various other features. The applied fluid may be heated to speed up the drying process. Usual drying of the imaging member would be for example at a temperature of at least 100° C. for at least 30 seconds. If the fluid requires curing to cause a desired chemical reaction, curing can be accomplished by ultraviolet radiation, electron beam radiation or gamma radiation.

The dried matrix image on the imaging member is then ready for a printing operation. Before inking the image, non-imaged areas of the fluid-receiving layer can be removed using an aqueous solution such as a fountain solution.

The resulting imaging member having an imagewise insoluble polymeric matrix on the hydrophilic support, can then be inked with a suitable lithographic printing ink (for example, with a fountain solution), and the inked image is then transferred to a suitable receiving material, such as paper, metal sheets or foils, ceramics, fabrics and other materials known in the art. The image can be transferred directly to the receiving materials, or indirectly by transfer first to what is known as a blanket roller, which in turn transfers the ink image to the receiving material.

The imaging members prepared using the present invention can be of any suitable shape or form, including but not limited to, printing plates, printing tapes (or webs), and printing cylinders or drums. Preferably, the imaging member is a printing plate.

The following examples are presented to illustrate, but not limit, the present invention.

EXAMPLE 1

This example demonstrates the practice of the present invention.

A colorless ink jetable fluid was prepared containing a 15% (by weight) solution of 3-glycidoxypropyltriethoxysilane in water. This fluid was then loaded into a black ink cartridge of a commercially available Epson Color STYLUS 200 ink jet printer by means of a small hole drilled into the cartridge. The commercial black ink had been flushed from the cartridge with water, which was displaced with nitrogen before loading the fluid.

A test page (image) in the memory of the printer was then "printed" onto a fluid-receiving layer composed of hydroxypropylcellulose that had been coated as a 2% solution in water onto a sheet of grained anodized aluminum support, by applying the ink jetable fluid in the manner noted above. The measured contact angle of the fluid on the fluid-receiving layer was about 30°.

After baking the element at 100° C. for 1 minute, the resulting printing plate with a dried water-insoluble sol-gel matrix was mounted on a commercially available A. B. Dick duplicator printing press and inked using a conventional lithographic ink and fountain solution. Fifty thousand excellent impressions were made with good ink density in the areas where the sol-gel matrix had been formed after application of the fluid. In addition, this printing plate had excellent protection from fingerprints.

COMPARATIVE EXAMPLE 1

Example 1 was repeated except that the fluid was applied directly to a grained anodized aluminum support (the fluid-receiving layer was omitted). The fluid spread so badly so that the image was unreadable. The contact angle of the fluid on the support was too low to measure (less than 5°). No printed impressions were obtained. Such a printing surface also readily shows fingerprints.

EXAMPLE 2

Example 1 was repeated except that the fluid-receiving layer was composed of polyethyenimine that has a contact angle of about 6°. The resulting printing plate had excellent protection from fingerprints.

The invention has been described in detail with particular reference to preferred embodiments thereof, but it will be understood that variations and modifications can be effected within the spirit and scope of the invention.

We claim:

1. An imaging method comprising the steps of:

A) imagewise applying a fluid to a fluid-receiving element that includes a hydrophilic support having thereon a water-soluble fluid-receiving layer said fluid comprising a mixture of a sol precursor and a liquid, and B) drying or curing said applied fluid to provide an imaging member having an oleophilic image composed of a sol-gel matrix on the surface thereof, wherein said fluid-receiving layer does not prevent attachment of said dried or cured fluid to said hydrophilic support.

2. The method of claim 1 wherein said support is a hydrophilic metal, polymeric or paper support.

3. The method of claim 2 wherein said support is a roughened aluminum support.

4. The method of claim 1 wherein said fluid-receiving layer comprises a water-soluble cellulosic material, a water-soluble polymer, gum arabic, algin, carrageenan, fucoidan, laminaran, corn hull gum, gelatin, gum ghatti, karaya gum, locust bean gum, pectin, a dextran, agar, or guar gum.

5. The method of claim 4 wherein said fluid-receiving layer comprises hydroxypropylcellulose, hydroxyethylcellulose, hydroxypropylmethylcellulose, carboxymethylcellulose, polyvinyl alcohol, a polyacrylamide, polyethylenimine or a polyvinylpyrrolidone.

6. The method of claim 5 wherein said sol precursor is a di- or triethyl, or di- or triester of a metal oxide or mixture thereof, said metal oxide has at least one melanophilic non-ether or non-ester side chain that has up to 25% of its molecular weight being contributed by oxygen, nitrogen or sulfur atoms, and the rest of its molecular weight being contributed by carbon and hydrogen atoms, said metal oxide being a silicon, beryllium, magnesium, aluminum, germanium, arsenic, indium, tin, antimony, tellurium, lead, bismuth, or a transition metal oxide.

7. The method of claim 6 wherein said metal oxide is a silicon oxide, aluminum oxide, titanium oxide or zirconium oxide.

8. The method of claim 6 wherein said metal oxide comprises two or three ether groups having 1 to 10 carbon atoms.

9. The method of claim 6 wherein said melanophilic non-ether or non-ester side chain is and alkyl-substituted or unsubstituted phenyl or an aryl-substituted or unsubstituted alkyl group having from 1 to 16 carbon atoms.

10. The method of claim 6 wherein said metal oxide is an alkyldi- or trialkoxysilane.

11. The method of claim 6 wherein said metal oxide is an epoxy substituted di- or trialkoxysilane.

12. The method of claim 6 wherein said fluid-receiving layer includes activated vinyl groups, and said fluid includes a mercapto substituted di- or trialkoxysilane.

13. The method of claim 5 wherein said liquid is water.

14. The method of claim 1 wherein said fluid is applied to said fluid-receiving element using an ink-jet printing head.

15. The method of claim 1 further comprising heating said applied fluid at a temperature of at least 100° C. for at least 30 seconds.

16. The method of claim 1 further comprising removing non-imaged areas of said fluid-receiving layer.

17. The method of claim 1 further comprising:

C) contacting said oleophilic image with a lithographic printing ink, and

D) imagewise transferring said printing ink to a receiving material.

18. The method of claim 17 wherein step C is carried out in the presence of a fountain solution.

* * * * *